US006283364B1

(12) United States Patent
Gray, Sr.

(10) Patent No.: US 6,283,364 B1
(45) Date of Patent: Sep. 4, 2001

(54) POSITIVE LOCKING CLAMSHELL

(75) Inventor: Larry D. Gray, Sr., Chesterfield, VA (US)

(73) Assignee: Westvaco Corporation, Stamford, CT (US)

( * ) Notice: Subject to any disclaimer, the term of this patent is extended or adjusted under 35 U.S.C. 154(b) by 0 days.

(21) Appl. No.: 09/749,784

(22) Filed: Dec. 28, 2000

(51) Int. Cl.[7] ..... B65D 43/14
(52) U.S. Cl. ..... 229/149; 229/114; 229/150
(58) Field of Search ..... 229/114, 125, 229/28, 146, 149, 150

(56) References Cited

U.S. PATENT DOCUMENTS 3,942,712 * 3/1976 Bundy et al. ..... 229/149
4,252,267 * 2/1981 Osborne ..... 229/149
4,964,561 * 10/1990 Whelan ..... 229/149
5,039,003 * 8/1991 Gordon et al. ..... 229/114
5,148,972 * 9/1992 Clayton ..... 229/149
5,718,368 * 2/1998 Rench et al. ..... 229/114
5,908,152 * 6/1999 Tullis ..... 229/114

* cited by examiner

*Primary Examiner*—Gary E. Elkins

(57) ABSTRACT

A clamshell container for disposable, single-use applications comprising a reinforced positive locking closure that includes an inverted tab closure element located within the front wall of one compartment thereof, and a slot cutout located within the front wall of a corresponding compartment thereof.

7 Claims, 7 Drawing Sheets

POSITIVE LOCKING CLAMSHELL

TECHNICAL APPLICABILITY AND FIELD OF THE INVENTION

This invention relates to a disposable container that may be used for packaging foodstuffs. In particular, the invention relates to a clamshell-type container having a positive opening mechanism that may be easily opened by the user.

BACKGROUND OF THE INVENTION

Disposable packaging, in particular, packaging cartons used in the fast food industry, must meet certain technical as well as economic criteria. For economic efficiency, such cartons should be cheap to manufacture in bulk quantities. Technically, the packaging must be constructed of a material that is chemically compatible with the foodstuffs being packaged, and not susceptible to show-through of oil or food juices on the outside of the container. Moreover, the packaging must be sturdy enough to allow handling without damage during a high speed forming process, and to permit stacking of the filled cartons. Such packaging is also desirably of a design that allows nesting of the empty formed containers for efficient storage.

Another desirable feature of such disposable packaging cartons is a closure means that can be easily opened and closed. In this regard, several closure means have been reported in the prior art. U.S. Pat. No. 2,956,720 (Rindal) describes a carton having an arrow lock closure consisting of a combination of a horizontal and angled slits forming a slit closure in one panel of the carton, and an arrow-shaped tab on the edge of a panel overlying the panel containing the slit. Closure is effected by pushing the arrow-shaped tab downward and toward the interior of the carton, thereby pressing the slit closure to separate the horizontally placed slits, thus allowing entry of the arrow tab. Because of the manner in which the slit closure is opened, the lower free end of the tab may be displaced appreciably inwardly against the contents of the carton, thereby forming a product-free, pocket-like area which ensures an opportunity for free entrance of the arrow tab.

U.S. Pat. No. 4,516,718 (Forbes) discloses a clamshell container having a positive locking closure. To close this container, the reference teaches engaging one or more upwardly directed tongue elements positioned at the free edges of a tray portion with one or more slit openings, each of which is positioned closely adjacent to a score line between the top panel and a side wall. By this closure means, the locking tongue is extends above and outside the lid when the carton is closed, and thus may be easily displaced by depressing the locking tongue element when it is desired to open the carton.

U.S. Pat. No. 4,763,832 (Forbes) describes a clamshell container with a bottom lock closure, in which the tray component includes at least one locking slot formed by a continuous cut line located in the tray front wall. This locking slot is closely adjacent to a score line that forms the fold between the bottom panel and front wall, and cooperates with a tongue element on the lid component, such that when the lid component and tray component are brought together to close the carton, the tongue element is automatically guided into the locking slot. The closure means is released by pressing inwardly on the front wall of the lid.

While the prior art, as discussed above, has utilized tab and slot closure elements together in disposable containers such as clamshells, in each instance the tab is exposed and is therefore prone to bending, tearing or other deformation during closure, which can compromise the closure means. Typically, the tab or tongue element is a relatively fragile element of the container because of its relatively small surface area and because it is pendent from and unsupported by the container wall from which it is appended. A closure means having a tab element, which can be opened without direct handling of the tab, is thus desirable.

The prior art therefore evidences a need for a positive locking container having a tab and slot combination closure, in which the tab element is less susceptible to tearing or deformation. Such a container should further be easily opened by applying positive pressure to the exterior of the container without direct handling of the tab. Such a container should also be inexpensive to manufacture, and capable of being stored efficiently before and during use.

SUMMARY OF THE INVENTION

This need in the art is met by the various embodiments of the present invention, which provide a clamshell container having a positive locking closure that is easy to open. This positive locking container may find use in multiple applications including, for example, the foodservice industry.

In particular, the container of the present invention comprises:

a) a tray having a bottom panel and upstanding front, side and rear tray walls, wherein the front tray wall includes a fold line forming an extension of said front tray wall; said tray having a slot cutout located therein; and b) a lid having a top panel and downwardly extending front, side and rear lid walls, wherein the front lid wall includes a fold line creating an extension of said front lid wall, said extension having a tab element located therein such that when the extension is folded toward the interior of the container, the tab element is inverted to provide an inverted tab locking means;

said container having a tab closure means, which is provided by engagement of the slot cutout with the inverted tab locking means.

The top panel is preferably rectangular in configuration, while the bottom panel is suitably either rectangular or of a curved rectangular configuration to better accommodate a range of food shapes, and also to prevent the user from confusing the lid portion with the tray portion of the container. The front tray wall may be extended to a height greater than the height of the side or rear tray walls. One reason for providing such an extension of the front tray wall is to provide a degree of overlap between the extension and the front lid wall and/or the top panel. In this manner, greater reinforcement is provided to the front lid wall and lid to create a sturdy package.

One element of the positive locking closure of the invention is a tab element formed in an extension portion of the front lid wall. The extension is folded toward the interior of the container when the clamshell is formed, and, accordingly, the tab element is inverted within the interior of the container, The positive locking means further includes a slot cutout, located within the front tray wall, for engagement of the inverted tab element to close the container. This slot cutout may be positioned above, below or contiguous with the fold line of the front tray wall, thereby affording some flexibility in the design of the container depending on the type of material used in its construction and its intended application. The slot cutout preferably comprises a linear top cut formed parallel to the top edge of an extension of the front tray wall, a pair of bottom cuts that are linear and parallel to the top cut, and a curvilinear cut imposed between the pair of bottom cuts to form a lip or open region for accepting a tab element, and a pair of curvilinear side cuts joining the ends of the top cut to the pair of bottom cuts.

The positive locking closure is secured by engaging the inverted tab element with the slot cutout, and the closure means is hidden behind the front walls of the container. In this respect, direct handling of the tab and slot are avoided, and the problems of tearing, bending or other deformation caused by direct handling of the tab are eliminated.

In another aspect, the invention comprises a blank for forming a clamshell container comprising a first portion for forming a lid portion, a second portion for forming a tray portion and a score line or perforation connecting the first portion to the second portion; said first portion comprising a top panel and front, side and rear lid walls, said front lid wall having an extension that includes a tab locking means as a first positive locking closure means; and the second portion comprising a bottom panel and front, side and rear tray walls, said front tray wall having an extension that includes a slot cutout as a second positive locking closure means. The blanks may be cut and scored in an automated operation and formed mechanically or manually as needed in advance of packaging or at the packaging station.

The clamshell container is practicably designed for disposable, single-use applications, and, as such is usually formed from a paperboard material, although other materials could also be used. Suitable paperboard materials are of approved food use grade to provide for the packaging of foodstuffs. Examples of such materials include bleached board, unbleached board, laminated board, clay-coated board, corrugated board or any combination thereof. The size and dimensions of the clamshell container may be modified depending on the intended contents and upon the choice of materials used in manufacture. Accordingly, the clamshell may be of a shape and dimensions suited for holding various hot or cold foods.

DETAILED DESCRIPTION OF THE PREFERRED EMBODIMENTS OF THE INVENTION

Figure 1:
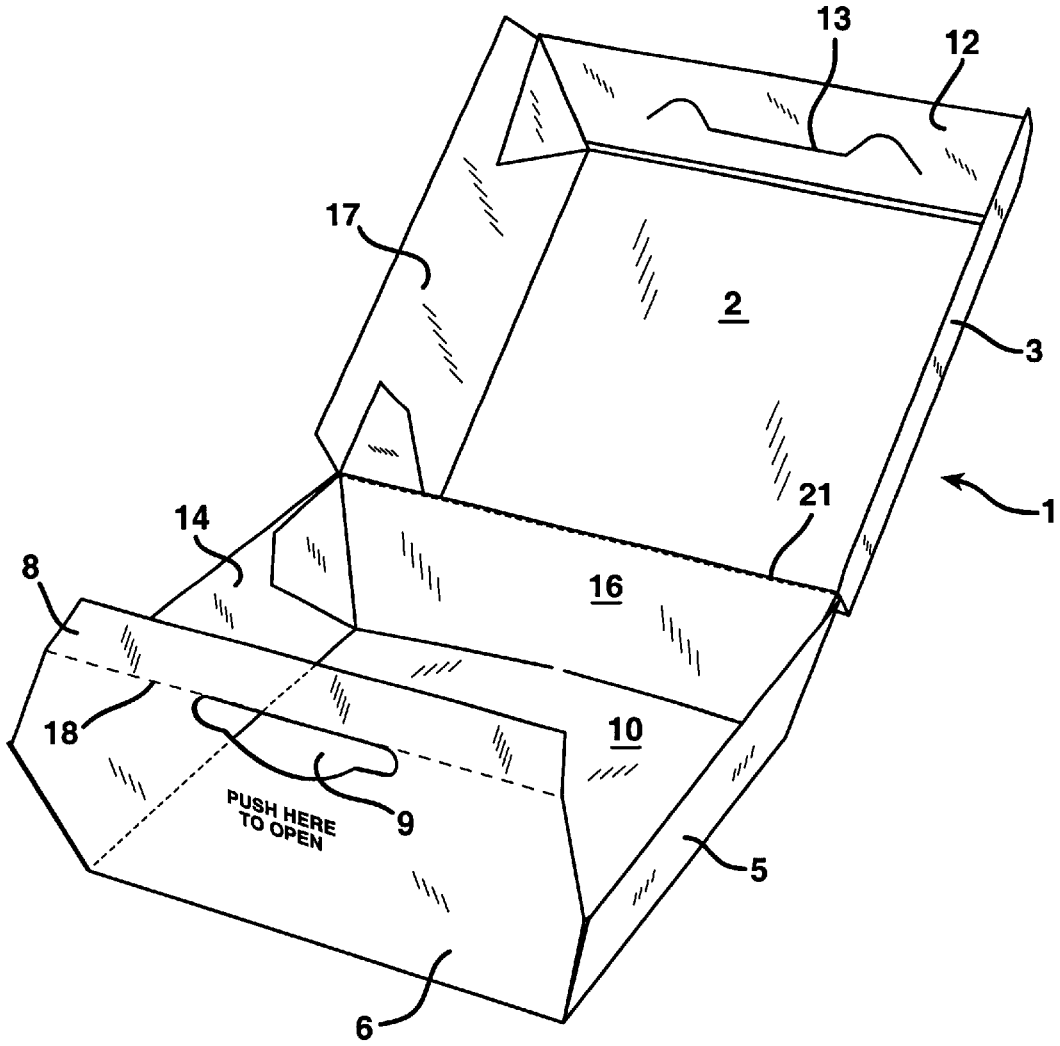
FIG. 1 is an isometric view of a clamshell container according to the invention.

As represented by the figures, a preferred clamshell container of the present invention comprises a tray formed by a bottom panel 10, a rear tray wall 16, a front tray wall 6 and side tray walls 5 and 14. The clamshell additionally consists of a lid formed by a top panel 2, side lid walls 3 and 17, front lid wall 11 and rear lid wall 15. The rear tray wall 16 is hingedly connected to rear lid wall 15 via a perforation 21.

Figure 2:
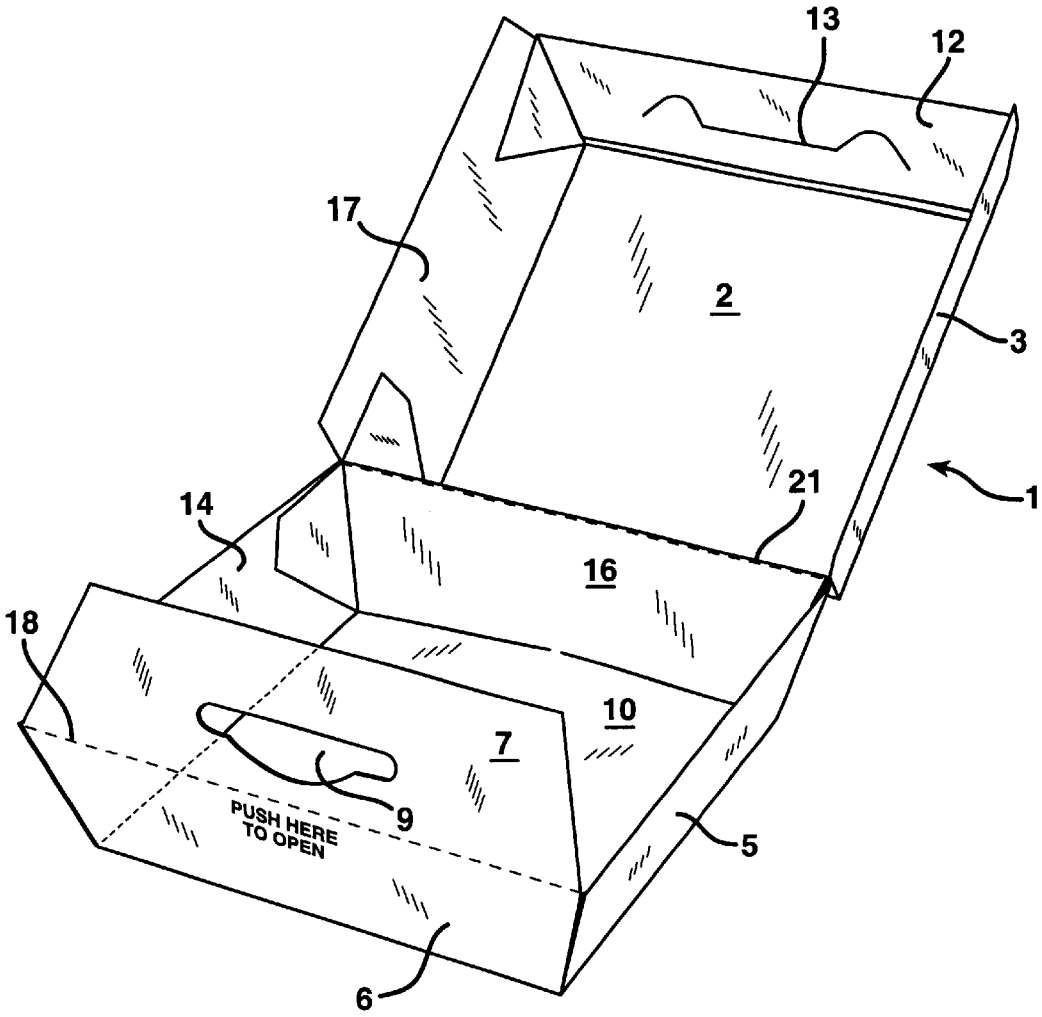
FIG. 2 is an isometric view of an alternative embodiment of a clamshell container according to the invention.

According to FIG. 1, the front tray wall 6 is extended to a height greater than the height of the rear tray wall 16 and side tray walls 5, 14, and further includes a fold line 18, which forms an extension 8 of the front tray wall 6. The front lid wall includes a tab closure means 13, located in an extension 12 of front lid wall 11, said extension 12 being foldably connected to the front lid wall 11. When the lid is closed, the additional height of the front tray wall 6 allows the extension 8 to be folded against the extension 12 inside front lid wall 11. By this means, additional frame support is provided to reinforce the lid of the clamshell. The front tray wall 6 further includes a slot cutout 9. While the position of the slot cutout 9 is generally centrally located in the front tray wall 6, the height of the front tray wall 6 and the position of the fold line 18 may be varied to change the degree of overlap between the extension 12 and the inside of the front lid wall 11. For example, according to FIG. 2, fold line 18 is positioned beneath the slot cutout 9 and the height of the front tray wall 6 is reduced such that the extension 7 formed by fold line 18 lies flat against extension 12 inside front lid wall 11, and abuts the edge of the top panel 2.

Figure 3:
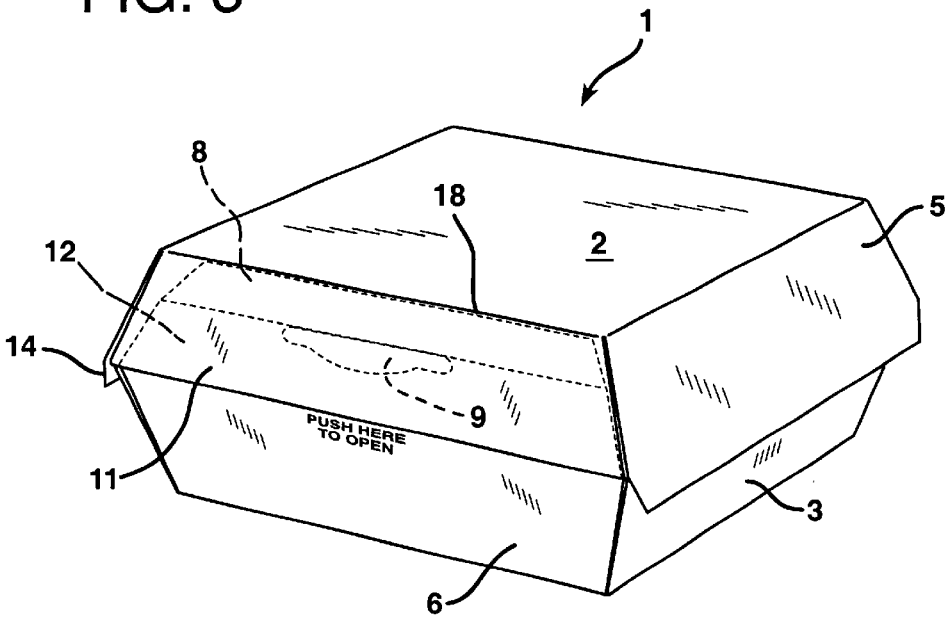
FIG. 3 is an isometric view of a closed clamshell according to the invention.

As shown in FIG. 3, the slot cutout 9 is located in the front tray wall 6 to correspond with a tab closure means (not shown) in the lid portion of the clamshell 1. The corresponding tab closure means is in the form of a tab 13 located in an extension 12 of front lid wall 11. The dimensions of the slot cutout 9 are suitably proportionate to the dimensions of the tab 13, the slot being wide enough to allow easy insertion of the tab into the slot cutout 9 but not so wide as to allow accidental disengagement of the closure. In addition, the slot cutout 9 comprises a widened region centrally located along its linear axis to provide more accessible accommodation of the tab 13 for closure of the clamshell. By this means the closure may be easily disengaged to open the container.

Figure 4:
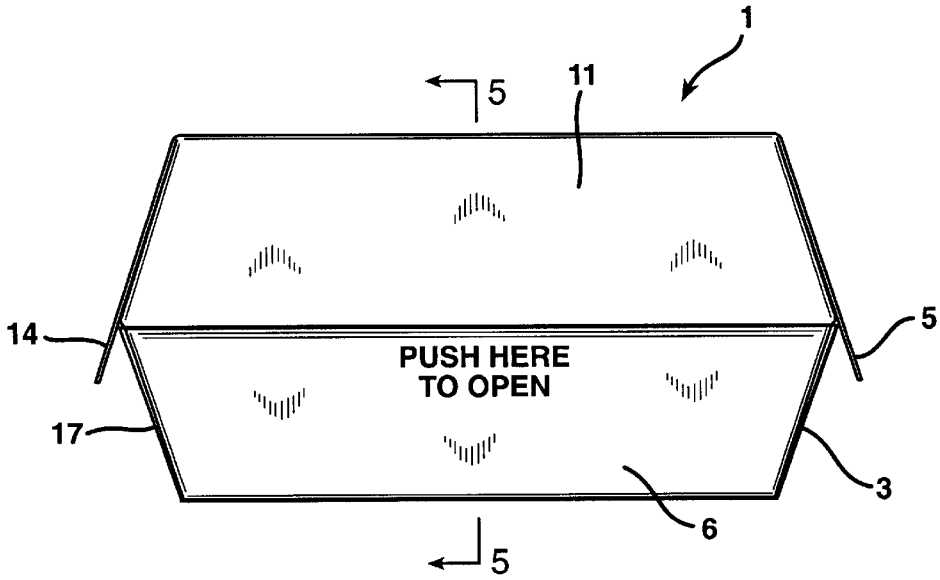
FIG. 4 is a two-dimensional front view of the clamshell of the invention.
Figure 5:
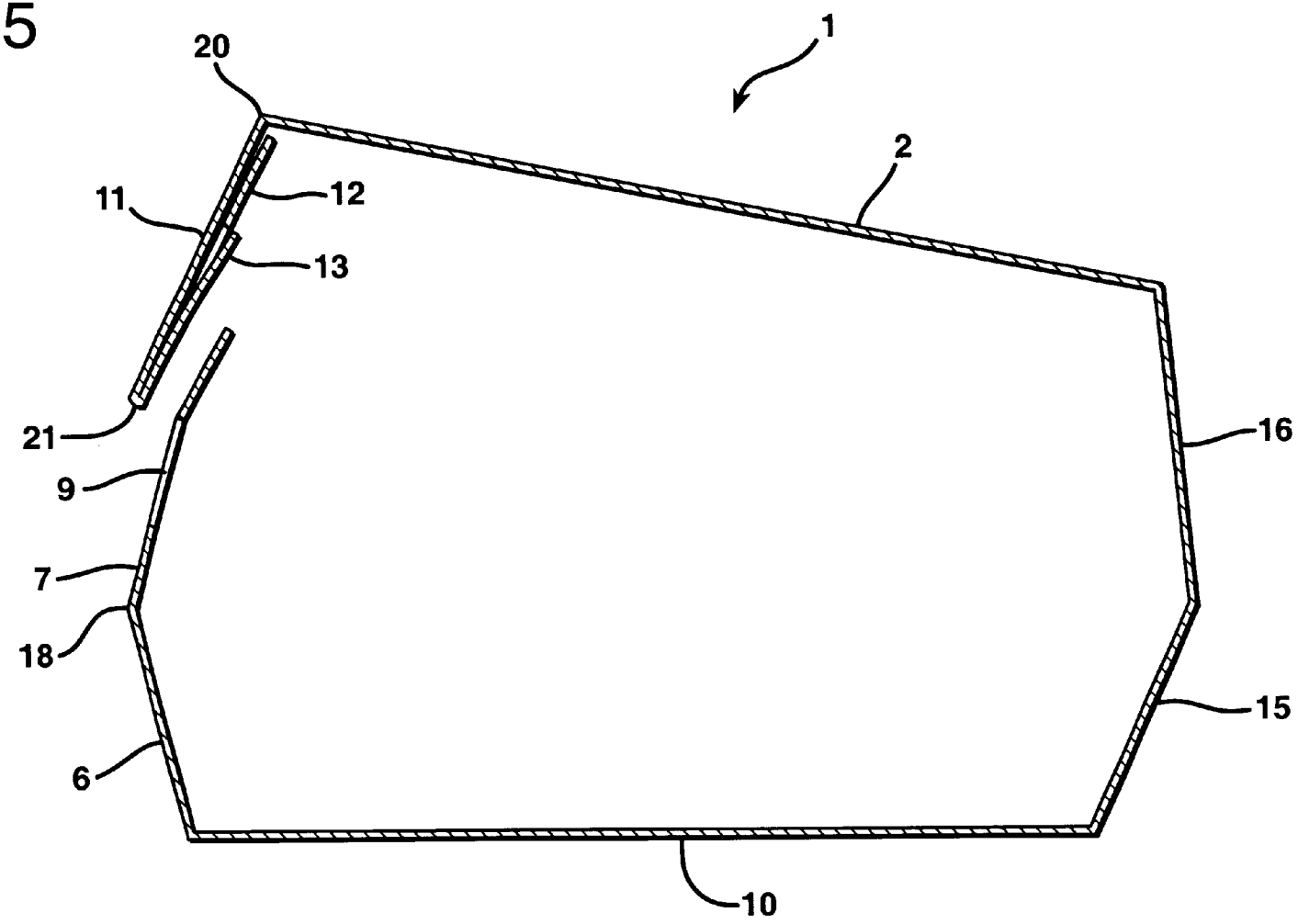
FIG. 5 is a cross-sectional representation of the clamshell with a positive locking closure means according to the invention.
Figure 6:
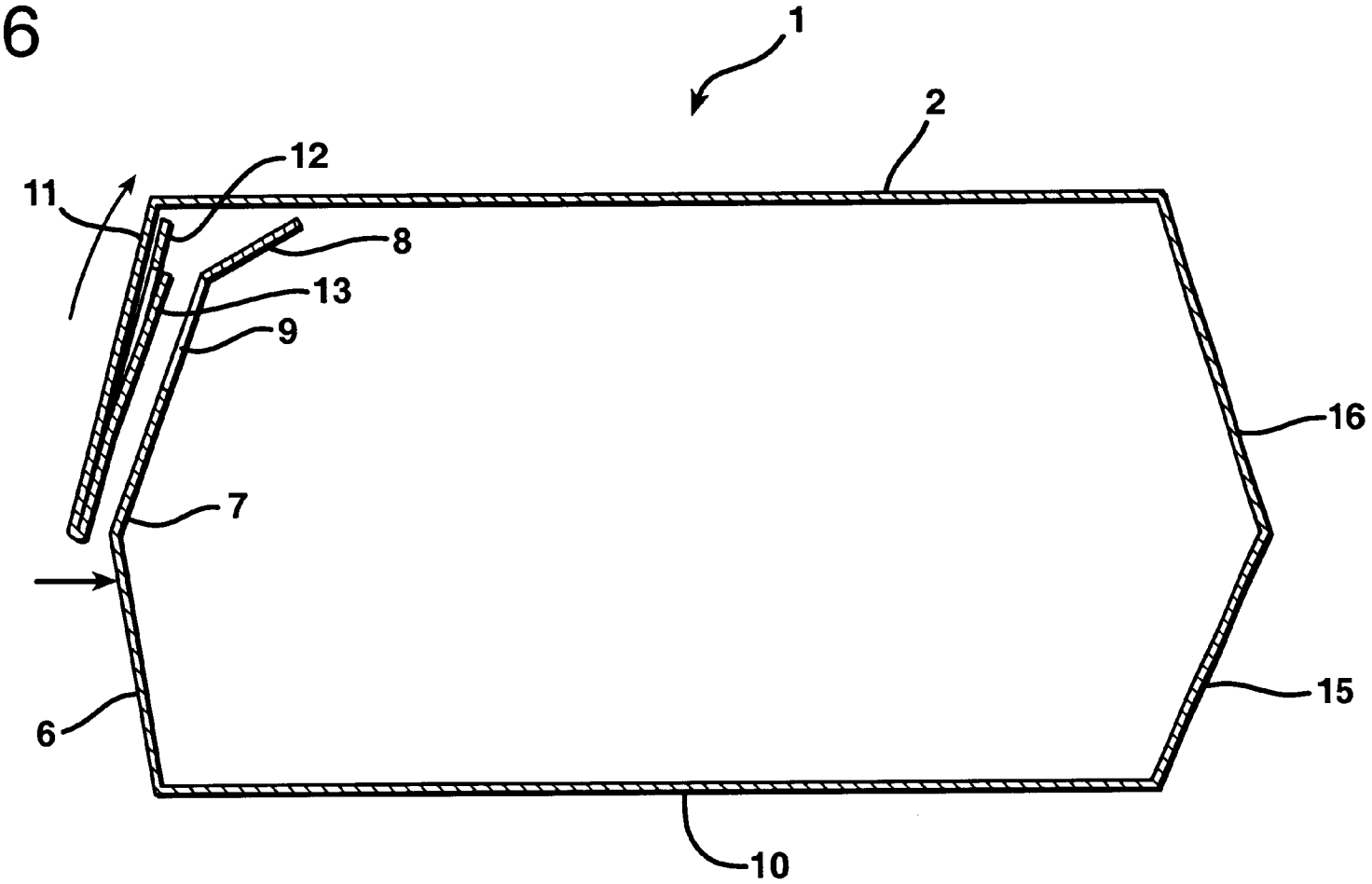
FIG. 6 is a cross-sectional representation of the clamshell according to the invention additionally showing the direction of force applied to open the container.

The clamshell 1 may be filled, for example with a foodstuff and then closed by pulling the front lid wall 11 and inwardly folded extension 12 downward over the front tray wall 6 to positively engage the tab 13 within the slot cutout 9. In this respect, the tab 13 is invertedly engaged with the slot cutout 9 and is hidden behind the front lid wall 11. As a result, the tab is not exposed to allow accidental tearing or other damage. Moreover, this closure means does not require intensive manipulation of the tab by the user. In the closed position, as demonstrated by FIG. 4, the side lid walls 3 and 17 are positioned over the side tray walls 5 and 14 to provide an angled abutment of each side tray wall 5, 14 against the inside of each side lid wall 3, 17. FIG. 5 is a cross-sectional representation of the clamshell 1 of the invention showing the positive locking closure. As depicted in FIG. 6, the clamshell I is closed by applying slight pressure to the front tray wall 6 and extension 7, such that tab 13, being in an inverted position within the folded extension 12 on the inside of the clamshell, is then engaged with the slot cutout 9. The positive locking feature of the invention is further displayed in the opening of the closed clamshell, whereby slight pressure is applied in the vicinity of the center of the front tray wall 6 and the extension 7 to disengage the inverted tab 13 from the slot cutout 9. By this means, additional physical maneuvering and direct handling of the tab to disengage it from the slot, as would be required with conventional tab closure containers, is avoided.

Figure 7:
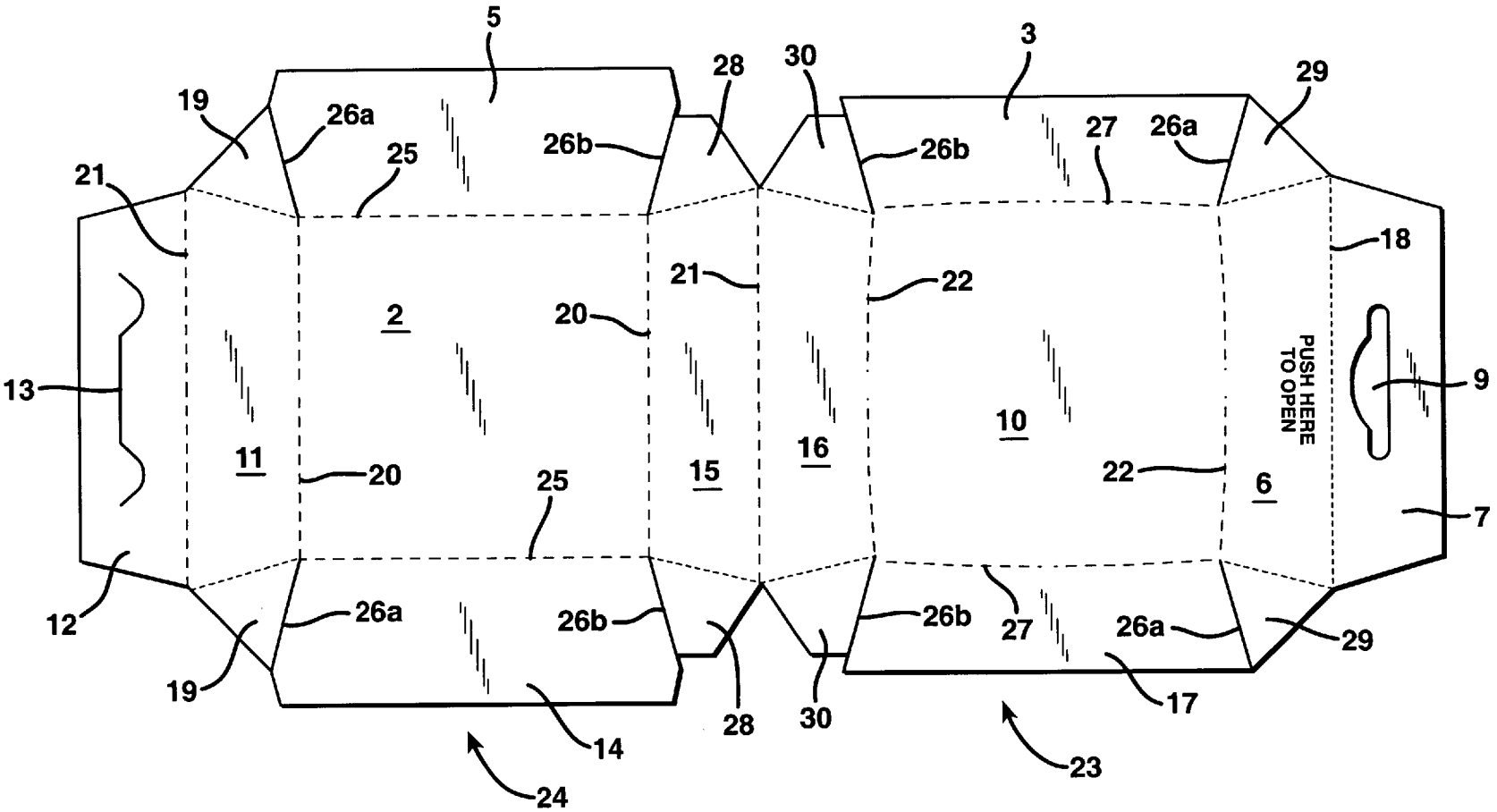
FIG. 7 is a planar view of a blank according to one embodiment of the invention.
Figure 8:
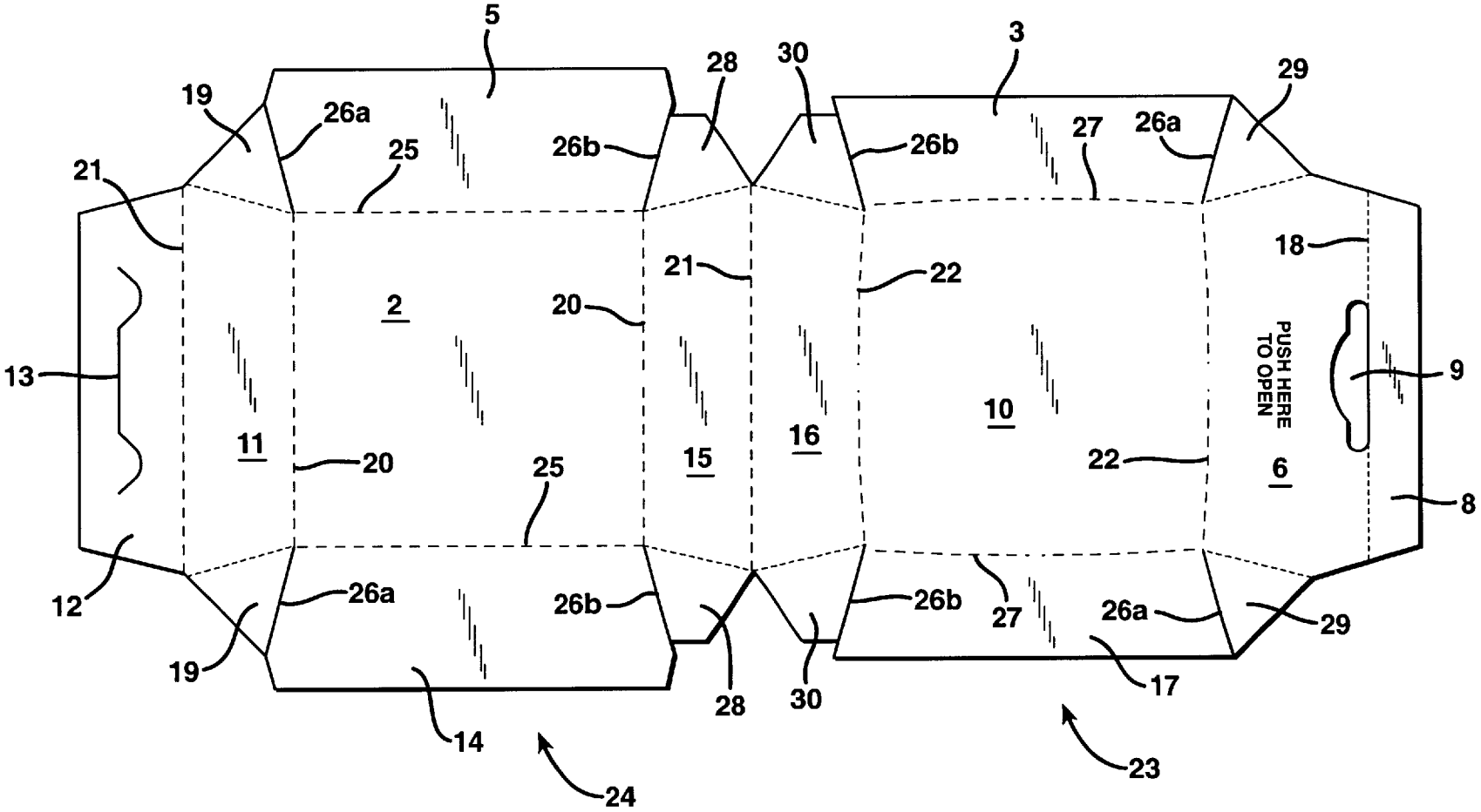
FIG. 8 is a planar view of a blank according to another embodiment of the invention.

The clamshell 1 may be formed from a blank cut according to the desired dimensions and scored to provide discrete panels upon folding, as is exhibited in FIGS. 7 and 8. The blank of FIG. 7 is formed from a paperboard sheet that is basically divided into a lid portion 23 and a tray portion 24. The lid portion 23 has slits 26*a* and 26*b*, which in conjunction with score lines 25 form gussets 19 and 28. Gussets 19 and 28 are folded toward the interior of the container and glued to form the front lid wall 11, rear lid wall 15 and side lid walls 5, 14 at an angle to the top panel 2. The tray portion 24 has slits 26*a* and 26*b*, which in conjunction with score lines 27 form gussets 29 and 30. Gussets 29, 30 are folded toward the interior of the container and glued to form front tray wall 6, rear tray wall 16 and side lid walls 3, 17. The front tray wall 6 is further scored with a fold line 18 so as to provide a bendable extension 7, the portion beneath the fold line 18 being contiguous in height with the side tray walls 3, 17 and the rear tray wall 16. As discussed previously, and as shown in FIG. 7, the score line 18 may be positioned below the slot cutout 9 so that when the clamshell is formed, the extension 7 can be bent inward to lay flat against the extension 12 inside the front lid wall 11 when the clamshell is closed. Alternatively, as shown in FIG. 8, the fold line 18 may be scored contiguous with the linear cut edge of the slot cutout 9 to provide that when the clamshell is closed, there is less overlap between the extension 8 and the extension 12.

The clamshell of the invention may be used in a variety of applications that require the use of single-use disposable containers. It provides the advantages of being easy to close and easy to open. In particular, the closure means eliminates the need for manual disengagement of the tab closure, as is required for standard containers, and which often results in the tab being torn or bent and therefore rendered ineffective for securing the container. The empty clamshells may be nested in the open position for efficient storage before use. Moreover, the clamshells of the invention may be stacked after filling, therefore providing spatial economy in the user environment.

It is believed that the present invention includes many other embodiments that may not be herein described in detail, but would nonetheless be appreciated by those skilled in the art from the description and drawings herein presented. Accordingly, this disclosure should not be read as being limited only to the foregoing examples or only to the designated preferred embodiments.

I claim:

1. A clamshell container comprising:

a) a tray having a bottom panel and upstanding front, side and rear tray walls, wherein the front tray wall includes a fold line forming an extension of said front tray wall; said tray having a slot cutout located therein; and b) a lid having a top panel and downwardly extending front, side and rear lid walls, wherein the front lid wall includes a fold line creating an extension of said front lid wall, said extension having a tab element located therein such that when the extension is folded toward the interior of the container, the tab element is inverted to provide an inverted tab locking means;

said clamshell container having a positive locking closure means, which is provided by engagement of the slot cutout with the inverted tab locking means.

2. The container of claim 1, wherein the fold line of the front tray wall is contiguous with the slot cutout.

3. The container of claim 1, wherein the fold line of the front tray wall is positioned below the slot cutout.

4. The container of claim 1, wherein the rear lid wall is hingedly connected to the rear tray wall by a score line or perforation.

5. The container of claim 1, wherein the slot cutout comprises a linear top cut formed parallel to the top edge of the extension of the front tray wall, a pair of bottom cuts that are linear and parallel to the top cut, a curvilinear cut imposed between the pair of bottom cuts to form a lip or open region for accepting a tab element, and a pair of curvilinear side cuts joining the ends of the top cut to the pair of bottom cuts.

6. A blank for forming a clamshell container comprising a first portion for forming a lid portion, a second portion for forming a tray portion, and a score line or perforation connecting the first portion to the second portion;

said first portion comprising a top panel and front, side and rear lid walls, said front lid wall having an extension that includes a tab locking means as a first positive locking closure means; and the second portion comprising a bottom panel and front, side and rear tray walls, said front tray wall having an extension that includes a slot cutout as a second positive locking closure means.

7. The blank of claim 6, which is formed from a paperboard substrate selected from the group consisting of bleached board, unbleached board, laminated board, clay-coated board, corrugated board or any combination thereof.

* * * * *